US007609277B2

(12) United States Patent
Noel et al.

(10) Patent No.: US 7,609,277 B2
(45) Date of Patent: Oct. 27, 2009

(54) METHOD AND APPARATUS FOR SPATIAL AND TEMPORAL DITHERING

(75) Inventors: Jean Noel, Nice (FR); Franck Seigneret, Saint-Jeannet (FR)

(73) Assignee: Texas Instruments Incorporated, Dallas, TX (US)

( * ) Notice: Subject to any disclaimer, the term of this patent is extended or adjusted under 35 U.S.C. 154(b) by 131 days.

(21) Appl. No.: 11/611,299

(22) Filed: Dec. 15, 2006

(65) Prior Publication Data

US 2007/0279432 A1 Dec. 6, 2007

(30) Foreign Application Priority Data

May 31, 2006 (EP) ..... 06290886

(51) Int. Cl.
*G09G 5/02* (2006.01)

(52) U.S. Cl. ..... 345/596; 345/691

(58) Field of Classification Search ..... None
See application file for complete search history.

(56) References Cited

U.S. PATENT DOCUMENTS

| | | | | |
|---|---|---|---|---|
| 5,389,948 | A * | 2/1995 | Liu | 345/691 |
| 5,424,755 | A * | 6/1995 | Lucas et al. | 345/605 |
| 5,442,406 | A * | 8/1995 | Altmanshofer et al. | 348/588 |
| 5,699,079 | A * | 12/1997 | Gossett | 345/605 |
| 5,734,369 | A | 3/1998 | Priem et al. | |
| 5,757,298 | A * | 5/1998 | Manley et al. | 341/138 |
| 5,831,624 | A * | 11/1998 | Tarolli et al. | 345/587 |
| 6,023,302 | A * | 2/2000 | MacInnis et al. | 348/597 |
| 6,040,876 | A | 3/2000 | Pettitt et al. | |
| 6,052,113 | A * | 4/2000 | Foster | 345/596 |
| 6,469,708 | B1 | 10/2002 | Wu et al. | |
| 6,661,421 | B1 * | 12/2003 | Schlapp | 345/530 |
| 6,714,206 | B1 | 3/2004 | Martin et al. | |
| 6,795,085 | B1 | 9/2004 | Doherty et al. | |
| 6,982,722 | B1 * | 1/2006 | Alben et al. | 345/596 |
| 7,126,611 | B1 * | 10/2006 | Weed | 345/589 |
| 7,268,790 | B1 * | 9/2007 | Small et al. | 345/596 |
| 7,298,893 | B2 * | 11/2007 | Kagawa et al. | 382/167 |
| 2002/0005854 | A1 * | 1/2002 | Deering et al. | 345/596 |
| 2003/0006994 | A1 | 1/2003 | Suzuki | |

(Continued)

FOREIGN PATENT DOCUMENTS

| | | |
|---|---|---|
| EP | 0 994 457 A2 | 4/2000 |

(Continued)

*Primary Examiner*—Kee M Tung
*Assistant Examiner*—David H Chu
(74) *Attorney, Agent, or Firm*—Ronald O. Neerings; Wade James Brady, III; Frederick J. Telecky, Jr.

(57) ABSTRACT

An apparatus and method for spatially and temporally dithering pixels. A pixel comprising at least one color component of a first size is provided. A dither addend is determined based on the display position of the pixel. The dither addend is added to the color component, and the color component is rounded to a second size. In one embodiment, a first frame may be provided for displaying the first pixel, the dither addend corresponding to the first frame. One or more additional frames for displaying the first pixel are provided, and one or more additional dither addends corresponding to the first pixel in the additional frames may be determined. The dither addend is different from the additional dither addends, and the additional dither addends are different from each other.

19 Claims, 5 Drawing Sheets

U.S. PATENT DOCUMENTS

2005/0021579 A1 1/2005 Bae et al.
2005/0190207 A1 9/2005 Kudo et al.
2005/0248583 A1* 11/2005 Gotoda ..... 345/596
2007/0030285 A1* 2/2007 Weitbruch et al. ..... 345/596
2007/0120794 A1* 5/2007 Shin et al. ..... 345/89
2007/0182897 A1* 8/2007 Shin ..... 349/117

FOREIGN PATENT DOCUMENTS

EP 0994457 A2 4/2000

* cited by examiner

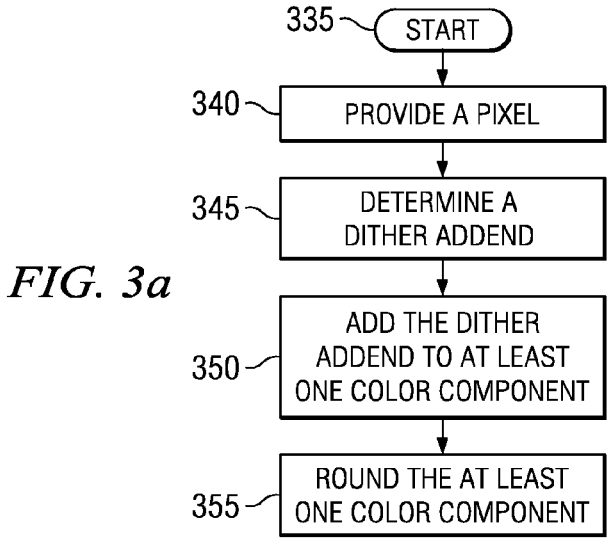
*FIG. 3a*
*FIG. 3b*
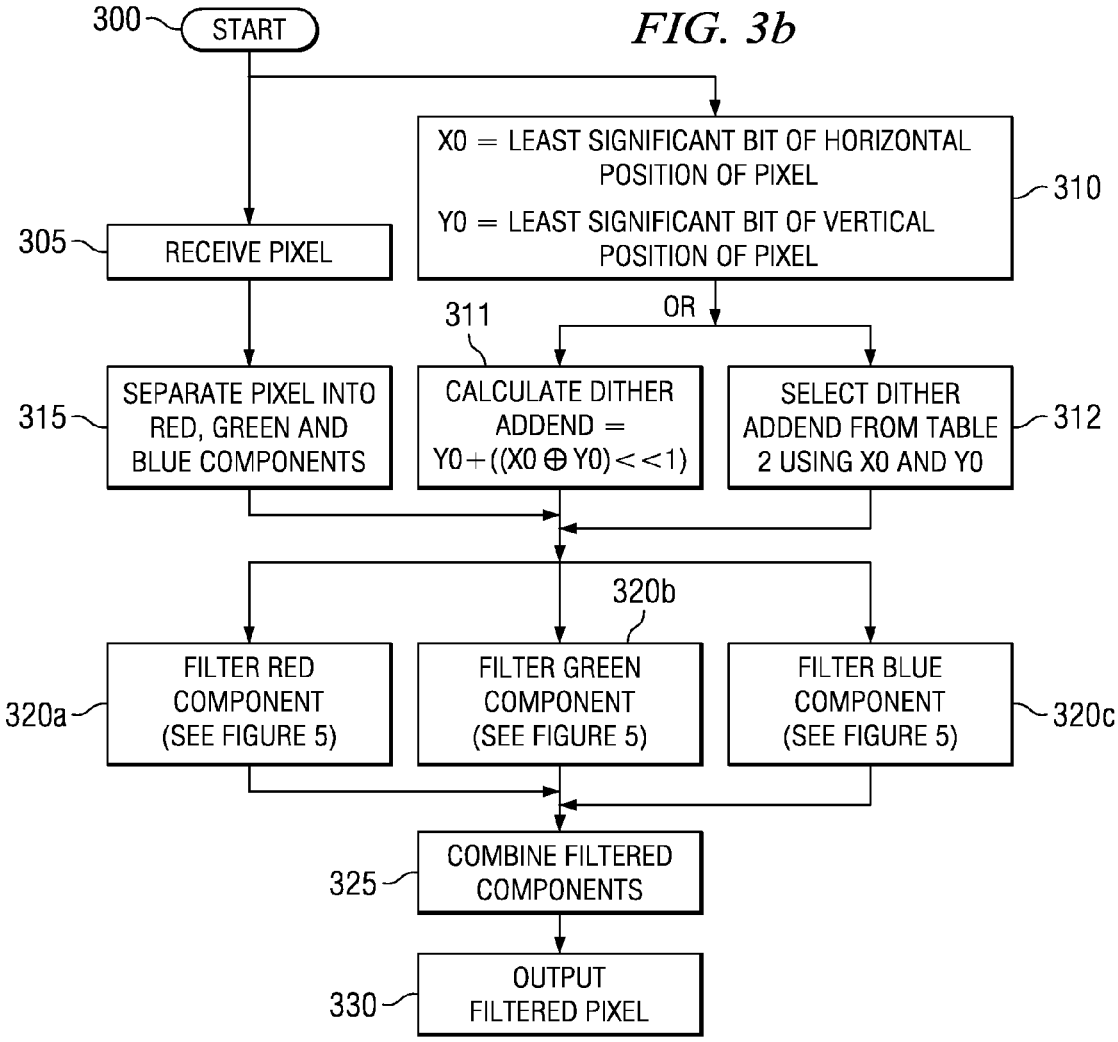

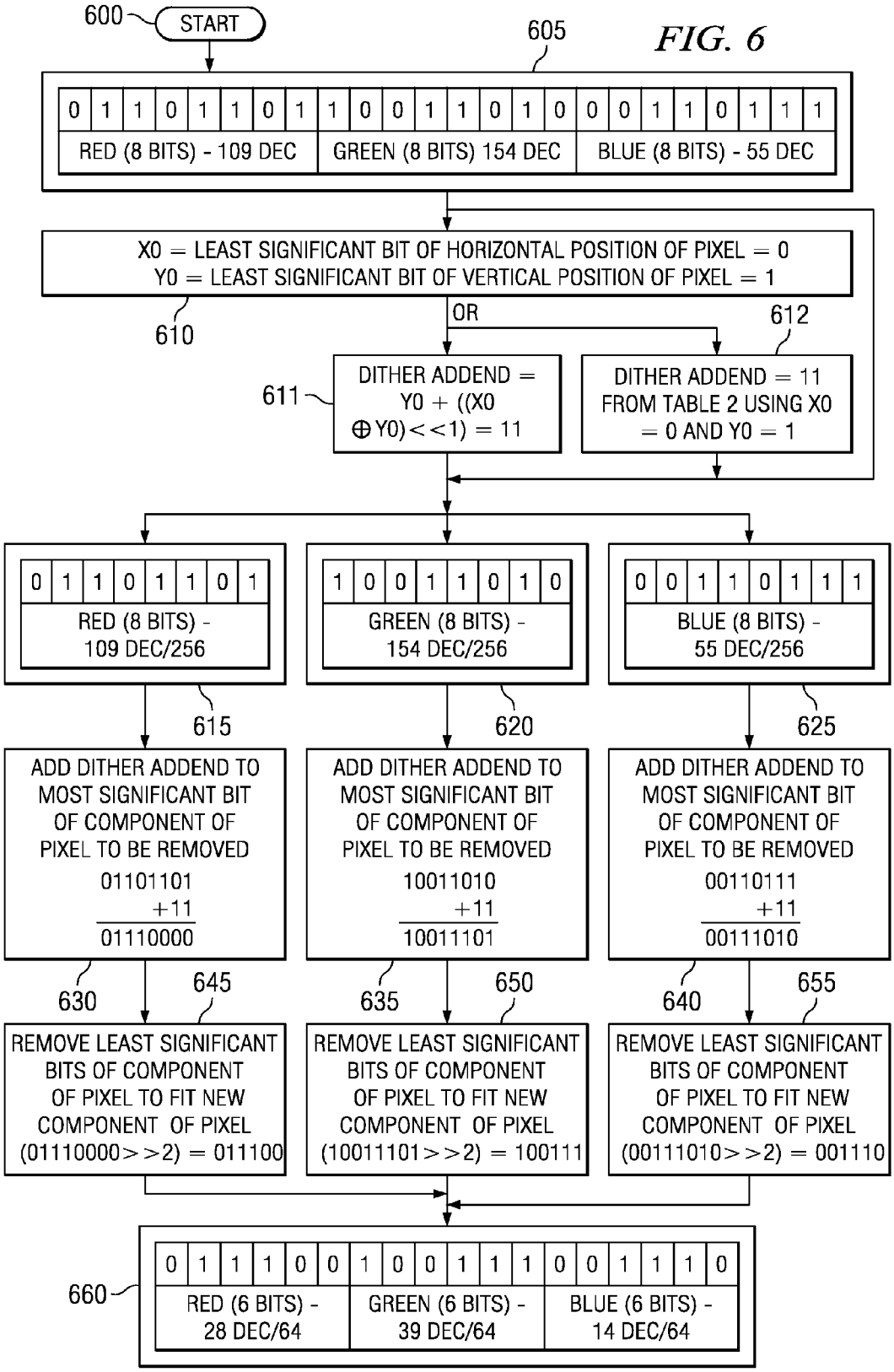
600
START
605
FIG. 6
0 1 1 0 1 1 0 1 1 0 0 1 1 0 1 0 0 0 1 1 0 1 1 1
RED (8 BITS) - 109 DEC
GREEN (8 BITS) 154 DEC
BLUE (8 BITS) - 55 DEC
X0 = LEAST SIGNIFICANT BIT OF HORIZONTAL POSITION OF PIXEL = 0
Y0 = LEAST SIGNIFICANT BIT OF VERTICAL POSITION OF PIXEL = 1
610
OR
612
611
DITHER ADDEND = Y0 + ((X0 ⊕ Y0)<<1) = 11
DITHER ADDEND = 11 FROM TABLE 2 USING X0 = 0 AND Y0 = 1
0 1 1 0 1 1 0 1
RED (8 BITS) - 109 DEC/256
1 0 0 1 1 0 1 0
GREEN (8 BITS) - 154 DEC/256
0 0 1 1 0 1 1 1
BLUE (8 BITS) - 55 DEC/256
615
620
625
ADD DITHER ADDEND TO MOST SIGNIFICANT BIT OF COMPONENT OF PIXEL TO BE REMOVED
01101101
+11
01110000
ADD DITHER ADDEND TO MOST SIGNIFICANT BIT OF COMPONENT OF PIXEL TO BE REMOVED
10011010
+11
10011101
ADD DITHER ADDEND TO MOST SIGNIFICANT BIT OF COMPONENT OF PIXEL TO BE REMOVED
00110111
+11
00111010
630
645
635
650
640
655
REMOVE LEAST SIGNIFICANT BITS OF COMPONENT OF PIXEL TO FIT NEW COMPONENT OF PIXEL (01110000>>2) = 011100
REMOVE LEAST SIGNIFICANT BITS OF COMPONENT OF PIXEL TO FIT NEW COMPONENT OF PIXEL (10011101>>2) = 100111
REMOVE LEAST SIGNIFICANT BITS OF COMPONENT OF PIXEL TO FIT NEW COMPONENT OF PIXEL (00111010>>2) = 001110
660
0 1 1 1 0 0 1 0 0 1 1 1 0 0 1 1 1 0
RED (6 BITS) - 28 DEC/64
GREEN (6 BITS) - 39 DEC/64
BLUE (6 BITS) - 14 DEC/64

METHOD AND APPARATUS FOR SPATIAL AND TEMPORAL DITHERING

CROSS REFERENCE TO RELATED APPLICATIONS

This application claims priority to EPO Application No. 06290886.8, filed May 31, 2006, incorporated herein by reference.

TECHNICAL FIELD OF THE INVENTION

The present invention generally relates to image information conversion. More particularly, the invention relates to spatial dithering and temporal dithering of pixels in one or more frames of image information.

BACKGROUND OF THE INVENTION

In an electronic device containing a display system, a display controller typically receives information from a processor or memory storage device and transmits the information to a display device. The information typically consists of rows of pixels configured to display images, such as pictures, text, and frames of video, stored in the memory storage device. For color displays, each pixel contains red, green, and blue components that may vary in intensity to form specific colors. For example, a 12-bit pixel may form 4,096 ($2^{12}$) different colors with four bits representing the red component, four bits representing the green component, and four bits representing the blue component. Each bit may be either of the two binary digits 0 or 1. A 16-bit pixel may form 65,536 ($2^{16}$) different colors with five bits representing each red and blue component, and six bits representing the green component. A 24-bit pixel may form 16,777,216 ($2^{24}$) different colors with eight bits representing each red, green, and blue component, and so on.

Display devices capable of displaying many colors are visually pleasing to a user. Accordingly, users may prefer a display system containing 16-bit pixels over 8-bit pixels and a display system containing 24-bit pixels over 16-bit pixels. However, using pixels with a large storage size may not be possible in all display systems. Display systems that use large-storage-size pixels may require a large bandwidth, a large memory storage capacity, long image processing times, and increased power consumption. In portable electronic devices in which low power consumption, low memory storage requirements, and low bandwidth requirements are highly desirable, display systems using large pixel storage sizes may not be appropriate.

One solution to this problem has been to remove least significant bits from color components in pixels to reduce pixel storage size at the expense of image quality. The least significant bits in a color component have less effect on the color of the pixel than the most significant bits. However, this technique may noticeably reduce image quality when displaying color gradients, which are gradual color shifts in an image. Color gradients displayed using this technique may appear to have undesirable, abrupt, and blocky color changes rather than smooth, gradual changes.

SUMMARY OF THE INVENTION

In one respect, disclosed is a method, including: providing a first pixel, wherein the first pixel comprises at least one color component of a first size; determining a dither addend; adding the dither addend to the color component; and rounding the color component to a second size.

In another respect, disclosed is an apparatus to manipulate one or more pixels, the apparatus operable to: provide a first pixel, wherein the first pixel comprises at least one color component of a first size; determine a dither addend; add the dither addend to the color component; and round the color component to a second size.

In yet another respect, disclosed is a computer program product on a computer operable medium, the computer program product comprising instructions effective to provide a first pixel, wherein the first pixel comprises at least one color component of a first size; determine a dither addend; add the dither addend to the color component; and round the color component to a second size.

BRIEF DESCRIPTION OF THE DRAWINGS

FIG. 3*a* shows, in accordance with some embodiments of the invention, a flowchart illustrating a method for spatially dithering a pixel;

FIG. 3*b* shows, in accordance with some embodiments of the invention, a flowchart further detailing the method for spatially dithering a pixel shown in FIG. 3*a;*

FIG. 6 shows, in accordance with some embodiments of the invention, an example of the method for spatially dithering a pixel illustrated in FIG. 3*b*.

NOTATION AND NOMENCLATURE

Figure 1:
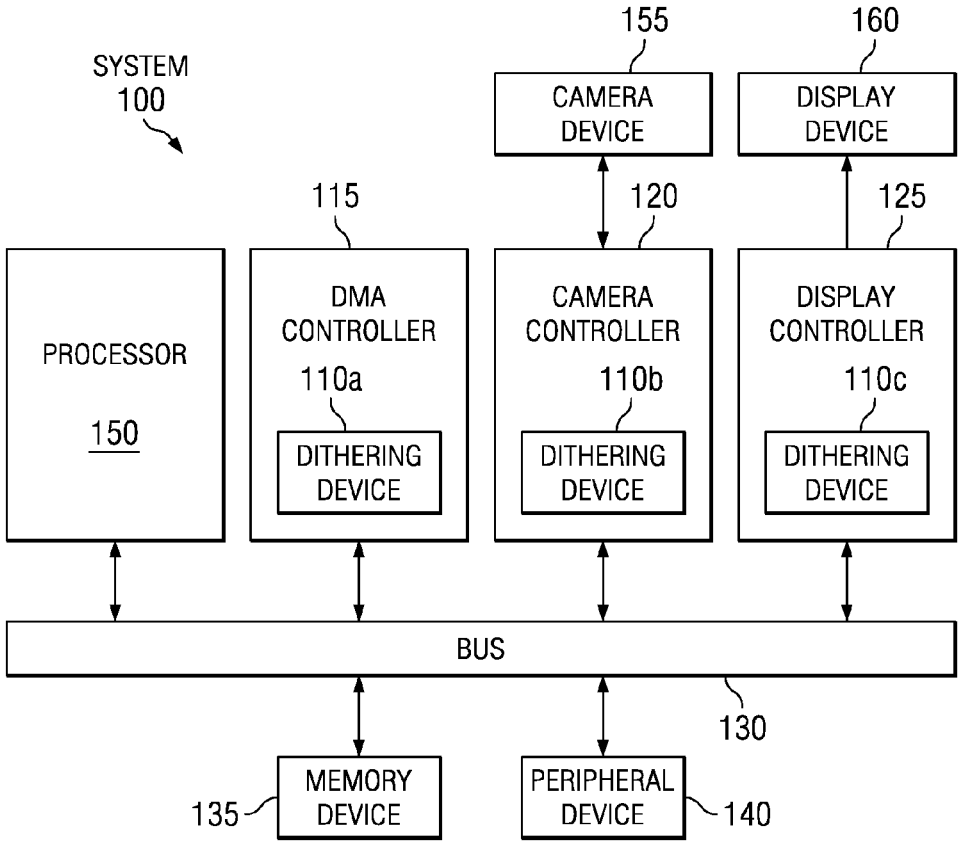
FIG. 1 shows, in accordance with some embodiments of the invention, a system that includes a display controller, a camera controller, a direct memory access (DMA) controller, and a processor.

Certain terms are used throughout the following description and claims to refer to particular system components and configurations. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections. Furthermore, the term "information" is intended to refer to any data, instructions, or control sequences that may be communicated between components of a device or between devices. For example, if information is sent between two components, data, instructions, control sequences, or any combination thereof may be sent between the two components.

DETAILED DESCRIPTION

In accordance with some embodiments of the invention, a first pixel containing at least one color component is provided. A dither addend is determined and added to the color component. The color component is then rounded to a second size. By applying this process to a plurality of pixels in an image, pixel storage size may be reduced and the image may appear to contain more colors than are capable of being displayed for the pixel storage size. The dither addend for each pixel may be determined in response to determining a display position of the pixel. The image may be a still image or a video image.

In some embodiments of the invention, a first frame for displaying the first pixel is provided. The dither addend may correspond to the first frame. The first pixel may also be displayed in one or more additional frames, and additional dither addends may be determined corresponding to the additional frames. The dither addend and the additional dither addends may be different from each other. By applying this process to a plurality of pixels in a plurality of frames, pixel storage size may be reduced and the frames of images may appear to contain more colors than are capable of being displayed for the pixel storage size. The dither addend for each pixel in each frame may also be determined in response to determining a display position of the pixel.

In some embodiments of the invention, a first pixel containing at least one color component is provided. A dither addend is determined, and the color component is rounded to a second size. The dither addend, which may be a binary value of 0 or 1, may then be added to the color component. By applying this process to a plurality of pixels in an image, pixel storage size may be reduced and the image may appear to contain more colors than are capable of being displayed with that pixel storage size. The dither addend for each pixel may be determined in response to determining a display position of the pixel.

Referring to a system 100 in FIG. 1, in accordance with some embodiments of the invention, a bus 130 connects to a display controller 125, a camera controller 120, a DMA controller 115, a processor 150, a memory device 135, and a peripheral device 140. System 100 may be an application-specific integrated circuit (ASIC), a system-on-chip (SOC), a mobile phone, a computer system, or any type of electronic device. Information, such as data, instructions, and control sequences, may transfer between the components of system 100 through bus 130. Image information, for example, may transfer from memory device 135 through bus 130 to display controller 125. Display controller 125 then displays the image information on a display device 160 coupled to display controller 125. Display device 160 may contain a thin-film transistor (TFT) display, a super twisted nematic (STN) display, a liquid crystal display (LCD), a cathode ray tube (CRT) display, or other type of display device.

Figure 2A:
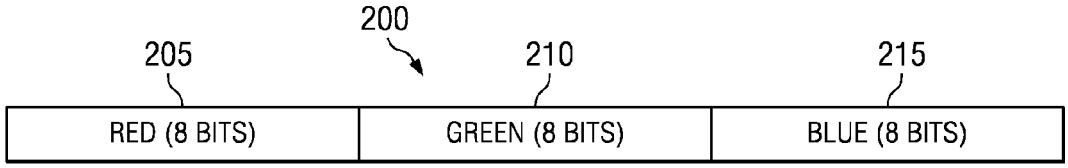
FIG. 2*a* shows, in accordance with some embodiments of the invention, a representation of a 24-bit pixel containing 8-bit red, green, and blue components.

Image information may consist of rows of pixels configured to display images, such as pictures, text, and frames of video, when transferred to display device 160. FIG. 2*a*, in accordance with some embodiments of the invention, shows a representation of a 24-bit pixel 200 (stored in memory device 135, for example) containing eight bits representing the red component 205 of pixel 200, eight bits representing the green component 210 of pixel 200, and eight bits representing the blue component 215 of pixel 200. The red, green, and blue components may vary in intensity to form a specific color. Each 8-bit component, for example, represents the intensity for a particular color (red, green, or blue). A value of 11111111b for the 8-bit component represents the greatest possible intensity, while a value of 00000000b for the component represents the lowest possible intensity.

Figure 2B:
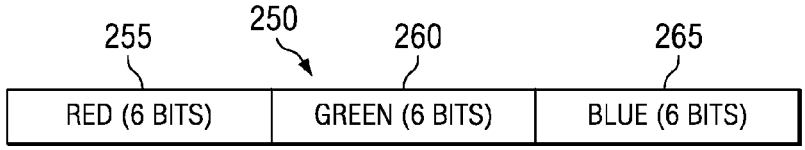
FIG. 2*b* shows, in accordance with some embodiments of the invention, a representation of an 18-bit pixel containing 6-bit red, green, and blue components.

FIG. 2*b*, in accordance with some embodiments of the invention, shows an 18-bit pixel 250 containing six bits for the red 255, green 260, and blue 265 components. Pixels may also be represented by 16 bits, 12 bits, more than 24 bits, and so on. A 12-bit pixel, for example, may represent 4,096 different colors with four bits representing each red, green, and blue component. A 16-bit pixel may represent 65,536 different colors with five bits representing each red and blue component, and six bits representing the green component. A 24-bit pixel may represent 16,777,216 different colors.

Returning to FIG. 1, processor 150, DMA controller 115, and camera controller 120 may be capable of writing pixel information to memory device 135. For example, camera controller 120 may receive pixel information from a camera device 155 coupled to camera controller 120 and write the pixel information to memory device 135. Camera controller 120, DMA controller 115, and display controller 125 may contain dithering devices 110*a-c* capable of receiving pixels, passing the pixels through a dithering filter described below, and reducing the storage size of the dithered pixels. The dithering filter may change the color intensity of the pixels of an image in a pattern that appears to the eye to contain more colors than are capable of being displayed for that pixel storage size. This may be described as spatial dithering. Thus, dithering device 110 may use spatial dithering to reduce the pixel storage size without significantly reducing the quality of the image to the human eye.

Dithering devices 110*a-c* may reduce the time of pixel transfer in system 100 and may thus reduce bus 130 bandwidth necessary for pixel transfer, reduce storage requirements in memory device 135, reduce image processing times, and decrease power consumption involved in image transfer. Dithering devices 110*a-c* may contain digital logic circuitry or analog circuitry. In some embodiments of the invention, dithering devices 110*a-c* may use software or a combination of software and hardware to perform the operations described above and below.

For example, camera controller 120 may pass 24-bit pixels (see FIG. 2*a*) from camera device 155 to dithering device 110*b*. Dithering device 110*b* passes the 24-bit pixels through the dithering filter and reduces the 24-bit pixels to 18-bit pixels (see FIG. 2*b*). The 18-bit pixels may be stored in memory device 135 for later display on display device 160. The 18-bit pixels take up less storage space in memory device 135 than the 24-bit pixels, thereby potentially reducing the storage requirements of memory device 135. Additionally, processor 150 or a graphics controller (not shown in FIG. 1) may perform image processing on the 18-bit filtered pixels faster than the original 24-bit pixels, thus decreasing processing demand on processor 150 and potentially reducing the power consumption of processor 150 or the graphics controller (not shown in FIG. 1). The dithering device 110*b* may also convert 24-bit pixels to 16-bit pixels, 18-bit pixels to 12-bit pixels, and so on.

Dithering device 110*a* in DMA controller 115 may pass pixels transferred between components in system 100 through the dithering filter and reduce the storage size of the dithered pixels. For example, peripheral device 140 may be a universal serial bus (USB) port connected to a personal computer. DMA controller 115 may be capable of transferring information from the USB port to memory device 135. The DMA controller 115 may pass image information containing pixels to dithering device 110*a*, and dithering device 110*a* may pass the pixels through the dithering filter and reduce the storage size of the pixels. DMA controller 115 then transfers the dithered pixels to memory device 135.

In some embodiments of the invention, display controller 125 may also contain dithering device 110*c*. Dithering device 110*c* may receive pixels from memory device 135, pass the pixels through the dithering filter, and reduce the pixel storage size to a size suitable for display on display device 160. For example, display controller 125 may receive image information from memory device 135 for display on display device 160. The image information from memory device 135 may contain 18-bit pixels and display device 160 may only be capable of displaying 12-bit pixels. The dithering device 110*c* filters the 18-bit pixels and reduces the size of the dithered pixels to 12 bits. Thus, display device 160 may display the image information from memory device 135.

In a portable electronic device, such as a laptop computer, music player, personal digital assistant (PDA), and so on, dithering devices 110*a-c* in system 100 may reduce bus 130 bandwidth necessary for pixel transfer, reduce storage requirements in memory device 135, reduce image processing times, and thereby decrease power consumption involved in image transfer without significantly reducing the quality of the image to the human eye.

Turning now to FIG. 3*a*, in accordance with some embodiments of the inventions, a flowchart illustrating spatial dithering of an image is shown beginning in block 335. A pixel containing at least one color component is provided in block 340. A dither addend is determined in block 345, and the dither addend is added to the color component in block 350. The color component is rounded to a second size in block 355. By applying this process to a plurality of pixels in an image, pixel storage size may be reduced and the image may appear to contain more colors than are capable of being displayed for the pixel storage size. In some embodiments of the invention, the process illustrated by the flowchart shown in FIG. 3*a* may be performed by dithering devices 110*a-c* shown in FIG. 1.

In some embodiments of the invention, the spatial dithering process described above may be applied to two-by-two blocks of pixels in an image. Dither addends for each neighboring pixel in the two-by-two blocks may be different from each other. By applying this process to a plurality of pixel blocks in an image, pixel storage size may be reduced and the image may appear to contain more colors than are capable of being displayed for the pixel storage size.

Figure 4:
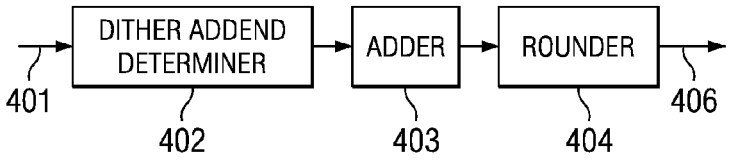
FIG. 4 shows, in accordance with some embodiments of the invention, a device operable to spatially dither a pixel.

Turning now to FIG. 4, in accordance with some embodiments of the inventions, a device operable to spatially dither an image is shown. A dither addend determiner 402 may receive a pixel from, for example, a processor (not shown) or direct memory access device (not shown) through a connection 401. Dither addend determiner 402 determines a dither addend and passes the dither addend and pixel to an adder 403 capable of adding the dither addend and pixel and passing the sum to a rounder 404. Rounder 404 may round the sum and pass the rounded sum through a connection 406 to a memory storage device (not shown), for example, or display screen (not shown).

In accordance with some embodiments of the invention, FIG. 3*b* shows a flowchart further detailing the spatial dithering process shown in FIG. 3*a*. The spatial dithering process begins in at block 300. As shown in block 305, a pixel is received from an image information source such as DMA controller 115, memory device 135, or camera controller 120 (see FIG. 1). As described above, an image consists of rows of pixels to be displayed on a display device. A least significant bit of a horizontal display position of the pixel in the image is assigned to a value X0, and a least significant bit of a vertical display position of the pixel in the image is assigned to a value of Y0, as shown in block 310. In some embodiments of the invention, the vertical and horizontal display positions of the pixel may be relative to the upper left hand corner of the image. The horizontal and vertical display positions of the pixel from the image information source may be received and the least significant bits identified, or a counter may be used to determine the horizontal and vertical display positions of the pixel based on the number of rows of pixels and the number of pixels per row of the image.

As shown in block 311, a dither addend is calculated using the X0 and Y0 values representing the least significant bit of the horizontal display position of the pixel and the least significant bit of the vertical display position of the pixel, respectively. In some embodiments of the invention, the dither addend is calculated using Formula 1 below:

$$\text{Dither Addend} = Y0 + ((X0 \oplus Y0) << 1) \qquad \text{Formula 1}$$

In Formula 1, the dither addend is equal to Y0 added to the one-bit-left-shifted result, represented by the symbol "<<" followed by the number one, of an exclusive or (XOR) function on X0 and Y0. The XOR function output is detailed in Table 1 below for different X0 and Y0 input values:

TABLE 1

| X0 | Y0 | Output |
|---|---|---|
| 0 | 0 | 0 |
| 0 | 1 | 1 |
| 1 | 0 | 1 |
| 1 | 1 | 0 |

As shown in Table 1, when X0 equals Y0, the XOR function outputs a 0. When X0 does not equal Y0, the XOR function outputs a 1.

The values for the dither addend for different X0 and Y0 values using Formula 1 are shown in Table 2 below:

TABLE 2

| | X0 = 0 | X0 = 1 |
|---|---|---|
| Y0 = 0 | 00b | 10b |
| Y0 = 1 | 11b | 01b |

When X0 equals 0 and Y0 equals 1, the dither addend equals 11b and so on. In some embodiments of the invention, the dither addend may alternatively be selected from Table 2, as shown in block 312. For example, values for the dither addend may be stored in a lookup table, and the values may be accessed based on the X0 and Y0 values of the pixel. In some other embodiments of the invention, the dither addend values may be hardwired or hardcoded to the values shown in Table 2.

In some other embodiments of the invention, the dither addend values in Table 2 may be rotated clockwise or counterclockwise by one, two, or three values. For example, Table 3 below represents the dither addend values in Table 2 rotated clockwise by one value:

TABLE 3

| | X0 = 0 | X0 = 1 |
|---|---|---|
| Y0 = 0 | 11b | 00b |
| Y0 = 1 | 01b | 10b |

Formula one described above may be modified to produce the dither addend values in Table 2 rotated clockwise or counter-clockwise by one, two, or three values.

Figure 5:
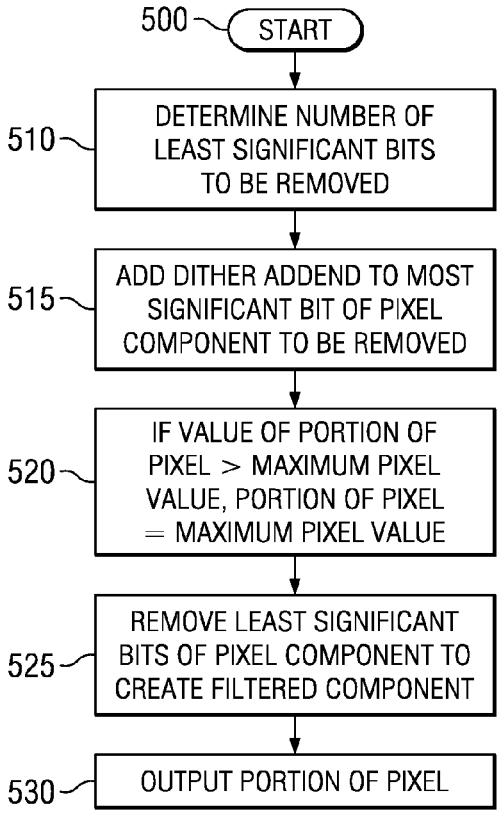
FIG. 5 shows, in accordance with some embodiments of the invention, a flowchart illustrating a method for filtering components of pixels to facilitate spatial dithering.

As shown in block 315, the pixel is separated into red, green, and blue components. In some embodiments of the invention, the pixel may contain a gray component or other color components (not shown in FIG. 3*b*). At block 320, each component is filtered, as shown in FIG. 5, by adding the dither addend to each component and rounding the component. In some embodiments of the invention, the dither addend may vary according to the color of the pixel. The filtered components are combined in block 325, and the filtered pixel is outputted in block 330. As described above, by applying this process to a plurality of pixels in an image, pixel storage size may be reduced and the image may appear to contain more colors than are capable of being displayed for that pixel storage size.

Turning now to FIG. 5, in accordance with some embodiments of the invention, a flowchart illustrating operation of the filter shown in block 320 in FIG. 3*b* is shown. The operation of the filter begins at block 500. The number of least significant bits to be removed from the component is determined in block 510. For example, for a conversion from a 24-bit pixel containing three 8-bit color components to a 12-bit pixel containing three 4-bit color components, dithering device 110 may determine in block 510 that four least significant bits are to be removed from each color component. Thus, a 4-bit color component will be produced from blocks 320 in FIG. 3*b*.

The dither addend calculated 311 or selected 312 in FIG. 3*b* may be added to the most significant bits of the least significant bits to be removed from the component, as shown in block 515. In FIG. 1, for example, dithering device 110*c* in display controller 125 may be designed to receive an 18-bit pixel consisting of three 6-bit color components (red, green, and blue) and output a 12-bit pixel to display device 160. Each 12-bit pixel may contain three 4-bit components. Two least significant bits from each color component are removed to reduce the output pixel to 12 bits. Thus, the dither addend is calculated and added to the second bit and first bit, respectively, of each color component of the 18-bit pixel using binary addition.

As shown in block 520, if the result of adding the dither addend to the most significant bit of the color component to be removed is greater than the maximum intensity the pixel component is capable of displaying, the color component is set to the maximum intensity value. For example, if the value of a red component of an 18-bit pixel is 111111b and a dither addend of 11b is added to two least significant bits of the red component, the component is set to 11111b, the maximum intensity value for a 6-bit component, rather than 1000001b, which the component is incapable of storing.

As described in block 525, the least significant bits of the color component are truncated to create a filtered component. Returning to the 18-bit pixel to 12-bit pixel example above, the two least significant bits of each color component are removed in block 525 to produce the 12-bit pixel containing three 4-bit components. In some embodiments of the invention, each color component from the 18-bit pixel may be right shifted by two bits to reduce the pixel size after adding the dither addend value. The filtered component is then outputted in block 530 and combined with the remaining color components in FIG. 3*b* to output a filtered pixel. In some embodiments of the invention, the dither addend value may be subtracted from the color component before removing the least significant bits to create a filtered component.

In some embodiments of the invention, the process illustrated by the flowcharts shown in FIGS. 3*b* and 5 may be performed by dithering device 110 shown in FIG. 1. FIG. 6, in accordance with some embodiments of the invention, shows an example of the operation of dithering device 110*b* in camera controller 120. The operation of dithering device 110*b* begins at block 600. As shown in block 605, dithering device 110*b* receives a 24-bit pixel from an image captured by camera device 155. Dithering device 110*b* filters the 24-bit pixel and reduces the filtered pixel to an 18-bit pixel to be stored in memory device 135 (see FIG. 1). The 24-bit pixel shown in block 605, 011011011001101000110111b, represents a light green color. Dithering device 110*b* assigns a least significant bit of a horizontal display position of the pixel to a value X0 and a least significant bit of a vertical display position of the pixel to a value of Y0, as shown in block 610. X0 is assigned a value of 0 and Y0 is assigned a value of 1, indicating that the pixel is in an even horizontal position and an odd vertical position relative to the top left corner of the image.

As shown in block 611, the dither addend is calculated as 11b using Formula 1 and the XO and Y0 values. In some embodiments of the invention, dither addend is selected from Table 2 using the X0 and Y0 values in block 612. Once the dither addend is determined, the 24-bit pixel is separated into 8-bit red, green, and blue components in blocks 615, 620, and 625, respectively. The dither addend is added to the most significant bits of the least significant bits to be removed from each color component, as shown in blocks 630, 635, and 640. Thus, for example, the dither addend value of 11b is added to two least significant bits of the red component in block 630 to produce an output of 01110000b.

Dithering device 110*b* then removes two least significant bits from each pixel component in blocks 645, 650, and 655, reducing each color component to 6 bits. In some embodiments of the invention, the color components may be right shifted by two bits to remove the least significant bits of each color component. The 6-bit red, green, and blue components may be combined to form an 18-bit filtered pixel in block 660. The 18-bit pixel shown in block 660, 011100100111001110b, represents a light green color similar to the light green color of the 24-bit pixel in block 605. The filtered 18-bit pixel is stored in memory device 135. Dithering device 110*b* then receives the next pixel from the image from camera device 155 and begins operation on the pixel at block 600.

Adding the dither addend value to each color component and removing the least significant bits of each color component in dither device 110*b* changes the pixel color intensity in the image from camera device 155 in a pattern that causes the image to appear to contain more colors than are capable of being displayed by an 18-bit pixel. Thus, the dithering device 110*b* reduces pixel storage size without reducing the quality of the image to the human eye. As described above, reducing the pixel storage size of the image stored in memory device 135 reduces bus 130 bandwidth necessary for image transfer, reduces storage requirements in memory device 135, reduces image processing times, and decreases power consumption involved in image transfer.

Figure 3C:
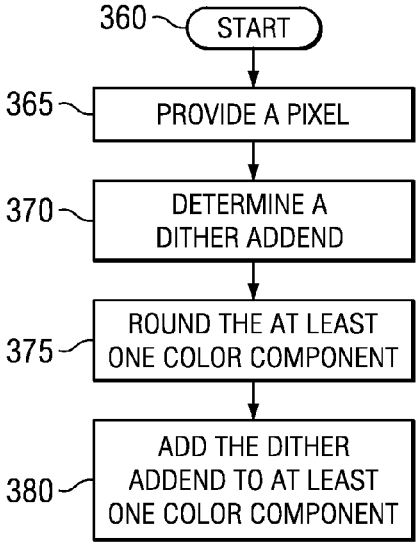
FIG. 3*c* shows, in accordance with some embodiments of the invention, a flowchart illustrating an alternative method for spatially dithering a pixel.

Referring to FIG. 3*c*, in accordance with some embodiments of the invention, a flowchart illustrating an alternative method of spatial dithering of an image is shown beginning in block 360. A pixel containing at least one color component is provided in block 365. A dither addend is determined in block 370. The color component is rounded to a second size in block 375. The dither addend is added to the rounded color component in block 380. By applying this process to a plurality of pixels in an image, pixel storage size may be reduced and the image may appear to contain more colors than are capable of being displayed for the pixel storage size. In some embodiments of the invention, the process illustrated by the flowchart shown in FIG. 3*c* may be performed by dithering device 110 shown in FIG. 1.

In the flowchart shown in FIG. 3*c*, the dither addend may be determined by the display position of the pixel and the values of the most significant bits of the least significant bits to be removed from the pixel when rounded. Tables 4a-d illustrate dither addend values for a conversion from a 24-bit pixel to an 18-bit pixel in which two least significant bits are removed from each color component.

TABLE 4a

| | Even Column | Odd Column |
|---|---|---|
| Even Row | 0 | 0 |
| Odd Row | 0 | 0 |

TABLE 4b

| | Even Column | Odd Column |
|---|---|---|
| Even Row | 0 | 0 |
| Odd Row | 1 | 0 |

TABLE 4c

| | Even Column | Odd Column |
|---|---|---|
| Even Row | 0 | 1 |
| Odd Row | 1 | 0 |

TABLE 4d

| | Even Column | Odd Column |
|---|---|---|
| Even Row | 0 | 1 |
| Odd Row | 1 | 1 |

The dither addends are selected from Table 4a when the two least significant bits of a color component are equal to 00b. Table 4b is used when the two least significant bits of a color component are equal to 01b. Table 4c is used when the two least significant bits of a color component are equal to 10b. Table 4d is used when the two least significant bits of a color component are equal to 11b. For example, a dither addend for a red color component with a value of 01101010b may be selected from Table 4c based on the two least significant bits. If the display position of the pixel containing the red color component is in an odd row and an even column, the dither addend is a 1. Thus, the dither addend value is added to the red component once the two least significant bits are removed to produce a value of 011011b.

In some embodiments of the invention, Tables 4a-d may be used for dithering pixel conversions of other sizes, such as converting 24-bit pixels to 12-bit pixels and so on. As described above, Tables 4a-4d may be used to select dither addend values based on the display position of the pixel and the values of the most significant bits of the least significant bits to be removed from the pixel when rounded.

Figure 7:
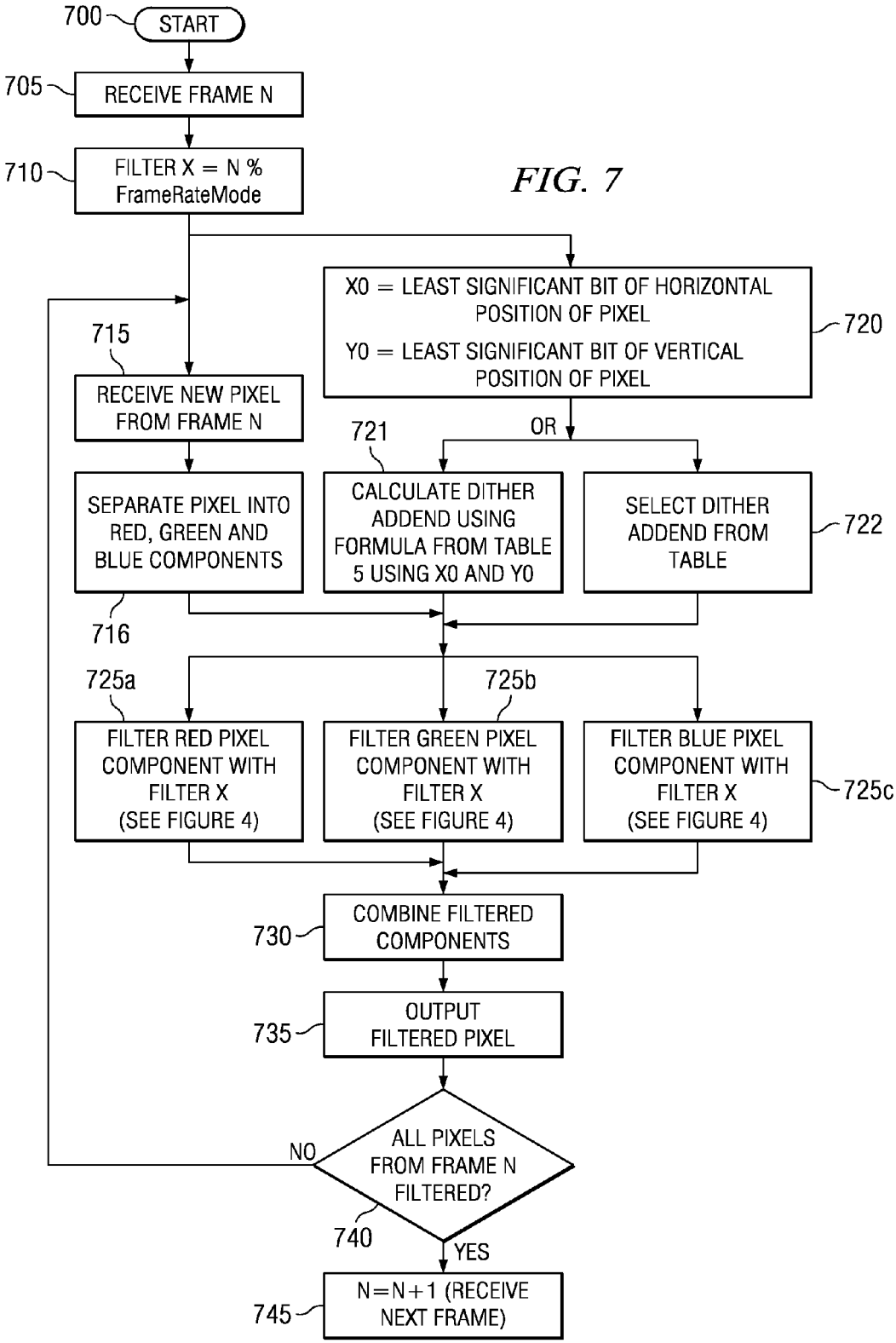
FIG. 7 shows, in accordance with some embodiments of the invention, a flowchart illustrating a method for spatially and temporally dithering frames of pixels.

In some embodiments of the invention, pixel color intensity in an image may change according to a specific pattern that changes over time, causing the image to appear to contain more colors than are capable of being displayed for the pixel storage size when viewed by the human eye. This may be described as temporal dithering. Turning now to FIG. 7, in accordance with some embodiments of the invention, a flowchart illustrating spatial and temporal dithering of an image is shown beginning in block 700. A frame of image information designated as frame N, where N may be a number ranging from 0 to infinity, is received in block 705. The frame may, for example, be received from a source such as DMA controller 115, memory device 135, or camera controller 120 in FIG. 1. A frame of image information consists of rows of pixels representing an image to be displayed on a display device.

A filter x is determined in block 710. As described below, filter x indicates which dither addend formula to use when filtering components of a pixel received in block 715. The filter x value may vary based on the frame number of the frame containing the pixel. In some embodiments of the invention, filter x is determined based on the value of N modulo a frame rate mode, where N represents the frame number of frame N and the frame rate mode represents the number of different dither addend formulas. For example, in some embodiments of the invention, dithering device 110 may use a frame rate mode of one, representing one dither addend formula to use to filter pixel components received in different frames. In some other embodiments, dithering device 110 may use a frame rate mode of four, representing four different dither addend formulas to use to filter pixel components received in different frames.

As shown in block 715, a pixel may be received from frame N. A least significant bit of a horizontal display position of the pixel is assigned to X0, and a least significant bit of a vertical display position of the pixel is assigned to Y0, as shown in block 720.

As shown in block 721, a dither addend value is calculated using the XO and Y0 values. The dither addend is calculated using the dither addend formula selected from Table 5 below according to the filter x value:

TABLE 5

| Filter X Value | Dither Addend Formula |
|---|---|
| 0 | Dither Addend = $Y0 + ((X0 \oplus Y0) << 1)$ |
| 1 | Dither Addend = $\overline{Y0} + ((X0 \oplus Y0) << 1)$ |
| 2 | Dither Addend = $\overline{X0} + ((\overline{X0} \oplus Y0) << 1)$ |
| 3 | Dither Addend = $X0 + ((\overline{X0} \oplus Y0) << 1)$ |

If the filter x value is determined as 3, for example, the dither addend equals X0 added to a one-bit-left-shifted result of an exclusive or (XOR) function on Y0 and the complement of X0. The XOR function is detailed in Table 1. The filter x value may change for each frame of information received in block 705.

In some embodiments of the invention, the dither addend formula associated with one filter x value may be switched with the dither addend formula associated with another filter x value. In some other embodiments of the invention, dithering device 110 may contain more than four filter x values and more than four dither addend formulas.

As shown in block 722, in some embodiments of the invention, the dither addend may be selected from a table (not shown) representing the dither addend output values for different filter x, Y0, and X0 values. For example, values for dither addends corresponding to various filter x, Y0, and X0 values may be stored in a lookup table. In some other embodiments of the invention, the dither addend values may be hardwired or hardcoded to the values described above.

As shown in block 716, the pixel is separated into red, green, and blue components. Each component is filtered at block 725, as illustrated in FIG. 5 and described above, and the filtered components are combined in block 730. Each component is filtered using the dither addend value calculated in block 721 or selected in block 722. The filtered pixel is outputted in block 735. If all the pixels from frame N have been filtered, as shown in block 740, the next frame of image information is received in block 745 and the spatial and temporal dithering process returns to block 700. If all the pixels from frame N have not been filtered, a new pixel from frame N is received in block 715.

In some embodiments of the invention, the process illustrated by the flowchart shown in FIG. 7 may be performed by dithering device 110 shown in FIG. 1. Dithering device 110, which is capable of spatial and temporal dithering, may filter pixels in a specific pattern that changes according to the frame number and display position of the pixels. Dithering device 110 may produce images that appear to contain more colors than are capable of being displayed for the pixel size contained in the images. Additionally, dithering device 110 may produce images containing smooth and accurate color gradients. In some embodiments of the invention, dithering device 110 reduces pixel storage size without reducing the quality of the image to the human eye. As described above, reducing the pixel size of an image stored in memory device 135 reduces bus 130 bandwidth necessary for image transfer, reduces storage requirements in memory device 135, reduces image processing times, and decreases power consumption involved in image transfer.

Those of skill will appreciate that the various illustrative logical blocks, modules, devices, and algorithm steps described in connection with the embodiments disclosed herein may be implemented as electronic hardware, computer software, or combinations of both. To illustrate clearly this interchangeability of hardware and software, various illustrative components, blocks, modules, circuits, and steps have been described above generally in terms of their functionality. Whether such functionality is implemented as hardware or software depends upon the particular application and design constraints imposed on the overall system. Those of skill in the art may implement the described functionality in varying ways for each particular application, but such implementation decisions should not be interpreted as causing a departure from the scope of the present invention.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of is the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method performed by a dithering device to reduce the size of a pixel, the method comprising:

determining by the dithering device a dither addend for a color component of the pixel based on a frame number of a frame comprising the pixel by determining a filter value as the frame number modulo a number of dither addend formulas available for determining dither addends, and determining the dither addend based on a dither addend formula of the dither addend formulas selected using the filter value;

adding the dither addend to the color component; and rounding the color component to reduce a size of the color; and wherein when the number of dither addend formulas is four, if the frame number modulo four is zero, the dither addend is a binary value determined based on a first dither addend formula, if the frame number modulo four is one, the dither addend is a binary value determined based on a second dither addend formula, if the frame number modulo four is two, the dither addend is a binary value determined based on a third dither addend formula, and if the frame number modulo four is three, the dither addend is a binary value determined based on a fourth digital addend formula.

2. The method of claim 1, wherein determining a dither addend further comprises determining the dither addend based on a display position of the pixel in the frame.

3. The method of claim 1, wherein determining a dither addend further comprises calculating the dither addend as a binary value selected responsive to the frame number from a group consisting of:

a least significant bit of a vertical display position of the first pixel added to a one-bit-left-shifted result of an exclusive or (XOR) function on a least significant bit of a horizontal display position of the pixel and the least significant bit of the vertical position of the pixel, a least significant bit of a complement of the vertical display position of the pixel added to the one-bit-left-shifted result of an exclusive or (XOR) function on the least significant bit of the horizontal display position of the pixel and the least significant bit of the vertical display position of the pixel, a least significant bit of a complement of the horizontal display position of the pixel added to a one-bit-left-shifted result of an exclusive or (XOR) function on the complement of the least significant bit of the horizontal display position of the pixel and the least significant bit of the vertical display position of the pixel, and the least significant bit of the horizontal display position of the pixel added to the one-bit-left-shifted result of an exclusive or (XOR) function on the complement of the least significant bit of the horizontal display position of the pixel and the least significant bit of the vertical display position of the pixel.

4. The method of claim 1, wherein determining a dither addend further comprises determining the dither addend based on a least significant bit of a horizontal display position of the pixel and a least significant bit of a vertical display position of the pixel.

5. The method of claim 1, wherein when the number of dither addend formulas is one, the dither addend is a binary value determined by adding a least significant bit of a vertical display position of the pixel to a one-bit-left-shifted result of an XOR function on a least significant bit of a horizontal display position of the pixel and the least significant bit of the vertical position of the pixel.

6. The method of claim 1, wherein when the number of dither addend formulas is two, if the frame number is an even number, the dither addend is a binary value determined based on a first dither addend formula of the dither addend formulas, and if the frame number is an odd number, the dither addend is a binary value determined based on a second dither addend formula of the dither addend formulas.

7. An apparatus comprising:

a processor; and a memory storing software instructions, wherein when executed by the processor, the software instructions cause the apparatus to perform a method comprising:

determining a dither addend for a color component of a pixel based on a frame number of a frame comprising the pixel by determining a filter value as the frame number modulo a number of dither addend formulas available for determining dither addends, and determining the dither addend based on a dither addend formula of the dither addend formulas selected using the filter value;

adding the dither addend to the color component; and rounding the color component to reduce a size of the color component; and wherein when the number of dither addend formulas is one, the dither addend is a binary value determined by adding a least significant bit of a vertical display position of the pixel to a one-bit-left-shifted result of an XOR function on a least significant bit of a horizontal display position of the pixel and the least significant bit of the vertical position of the pixel.

8. The apparatus of claim 7, wherein determining a dither addend further comprises determining the dither addend based on a display position of the pixel in the frame.

9. The apparatus of claim 7, wherein determining a dither addend further comprises determining the dither addend based on a least significant bit of a horizontal display position of the pixel and a least significant bit of a vertical display position of the pixel.

10. The apparatus of claim 7, wherein when the number of dither addend formulas is two, if the frame number is an even number, the dither addend is a binary value determined based on a first dither addend formula of the dither addend formulas, and if the frame number is an odd number, the dither addend is a binary value determined based on a second dither addend formula of the dither addend formulas.

11. The apparatus of claim 7, wherein when the number of dither addend formulas is four, if the frame number modulo four is zero, the dither addend is a binary value determined based on a first dither addend formula, if the frame number modulo four is one, the dither addend is a binary value determined based on a second dither addend formula, if the frame number modulo four is two, the dither addend is a binary value determined based on a third dither addend formula, and if the frame number modulo four is three, the dither addend is a binary value determined based on a fourth digital addend formula.

12. The apparatus of claim 7, wherein the dither addend formulas comprise one or more formulas from a group consisting of:

a least significant bit of a vertical display position of the first pixel added to a one-bit-left-shifted result of an exclusive or (XOR) function on a least significant bit of a horizontal display position of the pixel and the least significant bit of the vertical position of the pixel, a least significant bit of a complement of the vertical display position of the pixel added to the one-bit-left-shifted result of an exclusive or (XOR) function on the least significant bit of the horizontal display position of the pixel and the least significant bit of the vertical display position of the pixel, a least significant bit of a complement of the horizontal display position of the pixel added to a one-bit-left-shifted result of an exclusive or (XOR) function on the complement of the least significant bit of the horizontal display position of the pixel and the least significant bit of the vertical display position of the pixel, and the least significant bit of the horizontal display position of the pixel added to the one-bit-left-shifted result of an exclusive or (XOR) function on the complement of the least significant bit of the horizontal display position of the pixel and the least significant bit of the vertical display position of the pixel.

13. A system comprising:

a processor;

a memory operatively connected to the processor; and a dithering device operatively coupled to the processor and the memory, wherein the dithering device is operable to reduce a size of each pixel in a frame by:

determining a dither addend for the color components of the pixel based on a frame number of the frame by determining a filter value as the frame number modulo a number of dither addend formulas available for determining dither addends and determining the dither addend based on a dither addend formula of the dither addend formulas selected using the filter value;

adding the dither addend to each color component of the pixel;

truncating each color component after adding the dither addend; and generating the pixel using the truncated color; and wherein when the number of dither addend formulas is two, if the frame number is an even number, the dither addend is a binary value determined based on a first dither addend formula of the dither addend formulas, and if the frame number is an odd number, the dither addend is a binary value determined based on a second dither addend formula of the dither addend formulas.

14. The system of claim 13, wherein after the pixel is generated using the truncated color components, the pixel is stored in the memory.

15. The system of claim 13, wherein after the pixel is generated using the truncated color components, the pixel is displayed on a display device.

16. The system of claim 13, wherein determining a dither addend further comprises determining the dither addend based on a least significant bit of a horizontal display position of the pixel and a least significant bit of a vertical display position of the pixel.

17. The system of claim 13, wherein when the number of dither addend formulas is one, the dither addend is a binary value determined by adding a least significant bit of a vertical display position of the pixel to a one-bit-left-shifted result of an XOR function on a least significant bit of a horizontal display position of the pixel and the least significant bit of the vertical position of the pixel.

18. The system of claim 13, wherein when the number of dither addend formulas is four, if the frame number modulo four is zero, the dither addend is a binary value determined based on a first dither addend formula, if the frame number modulo four is one, the dither addend is a binary value determined based on a second dither addend formula, if the frame number modulo four is two, the dither addend is a binary value determined based on a third dither addend formula, and if the frame number modulo four is three, the dither addend is a binary value determined based on a fourth digital addend formula.

19. The system of claim 13, wherein the dither addend formulas comprise one or more formulas from a group consisting of:

a least significant bit of a vertical display position of the first pixel added to a one-bit-left-shifted result of an exclusive or (XOR) function on a least significant bit of a horizontal display position of the pixel and the least significant bit of the vertical position of the pixel, a least significant bit of a complement of the vertical display position of the pixel added to the one-bit-left-shifted result of an exclusive or (XOR) function on the least significant bit of the horizontal display position of the pixel and the least significant bit of the vertical display position of the pixel, a least significant bit of a complement of the horizontal display position of the pixel added to a one-bit-left-shifted result of an exclusive or (XOR) function on the complement of the least significant bit of the horizontal display position of the pixel and the least significant bit of the vertical display position of the pixel, and the least significant bit of the horizontal display position of the pixel added to the one-bit-left-shifted result of an exclusive or (XOR) function on the complement of the least significant bit of the horizontal display position of the pixel and the least significant bit of the vertical display position of the pixel.

* * * * *